US005883557A

United States Patent [19]

Pawlak et al.

[11] Patent Number: 5,883,557

[45] Date of Patent: Mar. 16, 1999

[54] MAGNETICALLY LATCHING SOLENOID APPARATUS

[75] Inventors: Andrzej Marian Pawlak, Troy; Chi Hung Leung, Rochester Hills, both of Mich.

[73] Assignee: General Motors Corporation, Detroit, Mich.

[21] Appl. No.: 961,836

[22] Filed: Oct. 31, 1997

[51] Int. Cl.[6] ..... H01H 9/00

[52] U.S. Cl. ..... 335/179; 335/177; 335/229; 335/230; 335/231; 335/232; 335/233; 335/234

[58] Field of Search ..... 335/177, 179, 335/229–234

[56] References Cited

U.S. PATENT DOCUMENTS

| | | | |
|---|---|---|---|
| 4,358,691 | 11/1982 | Naylor | 310/12 |
| 4,437,079 | 3/1984 | Hastings | 335/170 |
| 4,522,890 | 6/1985 | Patel | 335/234 |
| 4,644,311 | 2/1987 | Guery et al. | 335/230 |
| 4,704,591 | 11/1987 | Hafner | 335/229 |
| 4,737,750 | 4/1988 | Prouty | 335/177 |
| 4,779,582 | 10/1988 | Lequesne | 123/90.11 |
| 4,829,947 | 5/1989 | Lequesne | 123/90.11 |
| 5,024,247 | 6/1991 | Lembke | 137/82 |
| 5,272,458 | 12/1993 | Hoffman et al. | 335/179 |
| 5,365,210 | 11/1994 | Hines | 335/238 |

*Primary Examiner*—Michael L. Gellner
*Assistant Examiner*—Tuyen T. Nguyen
*Attorney, Agent, or Firm*—Vincent A. Cichosz

[57] ABSTRACT

A magnetically latching solenoid apparatus is characterized by a non-magnetic armature carrying a permanent magnet having poles aligned with the throw axis of the device. The poles of the magnet are substantially aligned with corresponding pole pieces and define respective variable air gaps therebetween. The apparatus assumes one of two bistable magnetically latched states according to the one of the air gaps across which the magnetic attractive force exceeds the magnetic attractive force across the other of the air gaps. Single or dual winding coils temporally excitable unidirectionally or bidirectionally and, in the case of dual winding coils mutually exclusively or contemporaneously, to cause the latch state to change.

8 Claims, 2 Drawing Sheets

MAGNETICALLY LATCHING SOLENOID APPARATUS

TECHNICAL FIELD

The present invention is related to magnetically latched solenoid apparatus.

BACKGROUND OF THE INVENTION

A variety of devices rely upon solenoid controlled apparatus. In automobiles, for example, various valves and electrical switches make use of solenoid controls which translate the motion or position of the solenoid armature to control position or state of valves or switches. Such devices are commonly referred to as solenoid controlled valves and relays, respectively. Many such devices assume a deenergized condition when current is removed from the solenoid and an energized condition when current is applied to the solenoid. The deenergized condition is characterized by a first armature position established by a bias spring acting upon the armature. The energized condition is characterized by a second armature position established by electromagnetic attraction of the armature to the solenoid core. In order that the second armature position is maintained, a holding current must continually be supplied to the solenoid lest the bias spring return the armature to the first armature position. Holding current is generally undesirable in automotive applications as such represents a source of electrical energy being dissipated out of an electrical system having severely limited electrical generation and storage capabilities. Additionally, integration of such devices embodied in relays onto printed circuit boards within various automotive or nonautomotive controllers has the additional shortfall of substantial heat generation resulting from ohmic losses of the solenoid which may preclude or limit such use or require special thermal management consideration.

Various mechanisms are known by which the necessity for holding current may be eliminated. Such mechanisms are generally referred to as latching mechanisms for their ability to retain an established position of state of a device. Magnetically latching solenoid devices are known which utilize permanent magnet force to latch an armature in one of two bistable conditions, the other bistable condition being latched mechanically by spring force. It has also been suggested to utilize permanent magnet force to selectively latch an armature in either of two bistable conditions. U.S. Pat. Nos. 4,737,750 and 5,272,458 for example show solenoid controlled apparatus including a permanent magnet coupled to an armature assembly and a single pole piece structure interacting with one pole of the permanent magnet. The pole piece is established at one of an aiding or opposing polarity with respect to the permanent magnet by way of opposite polarity flux established by an energized coil. Opposite polarity flux is established by bidirectional current delivery through a single coil or independent current delivery through a pair of oppositely wound coils. Bidirectional current delivery may require undesirably complex and costly driver circuitry while independent current delivery may require undesirably high coil mass, volume, and cost.

Additionally, as noted above in exposition of features of certain latching solenoid apparatus, a single pole piece interacts with the permanent magnet to effectuate state changes. The energy requirements between the two state changes may be very different owing to the different air gaps between the pole piece and magnet associated with each state. This changes the overall permeance of the magnetic circuit and may require substantially more flux to establish an attractive polarity than to establish an opposing polarity. This call for flux control may undesirably require various combinations of current delivery control such as by pulse width modulation depending upon the polarity desired, winding ratio other than unity between oppositely wound coils, and/or various performance and response trade-offs in toggling between states.

Inclusion of bias springs in the latching mechanism may also require substantial coil generated flux to counteract the spring force particularly in light of substantial air gaps and low permeance of the magnetic circuit in spring latched conditions. Additionally, inclusion of bias springs in the latching mechanism may also require substantial permanent magnet flux to counteract the spring force in magnetically latched conditions. Each of these shortfalls alone may undesirably add to mass, size and cost as attributable to larger coil(s), larger magnet, and /or high density permanent magnets.

Specifically with respect to relay applications, movable relay contacts pads are conventionally disposed at a distal end of a resilient conductor arm fixably coupled to the armature. As the armature is pulled toward the energized position against the solenoid coil a movable contact couples to a stationary contact and the resilient conductor yields under the attractive force between the armature and solenoid core until the armature motion is stopped by its contacting the core. Over time and cycles, the resiliency characteristics of the resilient conductor arm degrades and the contact pads wear, corrode and/or are consumed by arcing resulting in reduced contact force throughout the life of the relay. At the same time, arc erosion products formed on the surfaces of the contact pads are more resistive and require increased contact force to maintain low resistance across the contacts. Therefore, contact force reductions are undesirable since ohmic performance is positively correlated to contact force.

SUMMARY OF THE INVENTION

A bistable magnetically latched solenoid apparatus includes an armature apparatus having a non-magnetic shaft and a permanent magnet attached thereto. The magnetic poles of the permanent magnet are substantially aligned with the stroke axis of the armature assembly. The apparatus magnetic circuit includes a pair of pole pieces which are located in spaced adjacency with the permanent magnet such that the permanent magnet is substantially intermediate the pole pieces to provide a pair of air gaps; one between each pole face of the magnet and adjacent pole piece. Each air gap is variable with the stroke of the armature assembly and is characterized by a respective magnetic attractive force established thereacross by the permanent magnet. The bistable apparatus is further characterized by one of the air gaps being dominant with repect to the magnetic attractive force such that the armature assembly is magnetically latched in the position corresponding to the greater of the magnetic attractive forces across the two air gaps. A coil is provided for producing flux in the magnetic circuit when temporally energized to establish magnetic repulsive force across the dominant air gap to force the apparatus out of the prevailing latched position and into the other latched condition whereat the other of the air gaps is now dominant.

In accordance with one aspect of the invention, the coil may be a single winding coil energizable unidirectionally to establish a magnetic repulsive force across each air gap. The dominant air gap will see a greater repulsive force when the coil is temporally energized causing the armature to be repelled away from the prevailing latched position and into the other latched position.

In accordance with another aspect of the invention, the coil may be a dual winding coil, each winding being disposed on opposite sides of an intermediate flux return member which is adjacent the permanent magnet, wherein each coil is adapted for independent, unidirectional energization. In such arrangement, one of the windings is effective when energized to repel the armature out of a corresponding prevailing latch position and into the other latch position. The other of the windings is similarly effective to toggle the latch condition with respect to its corresponding prevailing latch position.

In accordance with yet another aspect of the invention wherein the coil is a dual winding coil as described, each coil is adapted for contemporaneous energization. In such arrangement, when energized with current in one direction, one of the windings establishes magnetic repulsive force across one of the air gaps while the other of the windings establishes magnetic attractive force across the other of the air gaps. When energized with current in the other direction, the air gap magnetic forces are reversed and the attraction and repulsion also reversed to effectuate reversal of the latch condition in the other direction. The coils in this latter arrangement may be coupled in either parallel or series combination.

BRIEF DESCRIPTION OF THE DRAWINGS

The present invention will now be described by way of example with reference to the accompanying drawings in which.

DESCRIPTION OF THE PREFERRED EMBODIMENT

Figure 2:
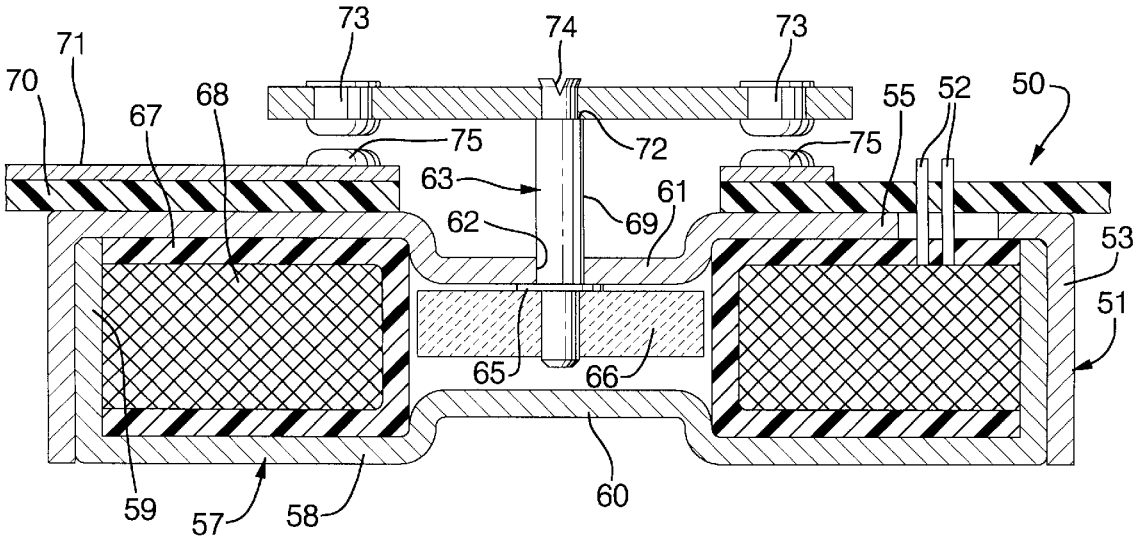
FIG. 2 illustrates a second embodiment of the present invention in sectional view of a single-winding bistable magnetically latched relay adapted for mounting to a circuit board in accord with the present invention; and, FIG. 3 illustrates a third embodiment of the present invention in sectional view of a single-winding bistable magnetically latched relay adapted for mounting to a circuit board in accord with the present invention.

With reference first to FIG. 2, one embodiment of a bistable magnetically latching apparatus in accord with the present invention is illustrated in partial section. The apparatus provides the electromechanical functions of a relay and in particular a relay integrated with a printed circuit board.

Relay 50 includes a housing comprising outer housing member 51 and inner housing member 57. Each housing member is formed from suitable magnetic material. In the present examples, it is preferred to stamp the inner and outer housing members form conventional stamping stock such as 20 mil 1008 steel. Each housing member includes a respective base portion 55,58 and wall portion 53,59. The base portions are preferably substantially round and the wall portions are substantially annular extending normal to the base portions at the outer periphery thereof. The inner housing member and outer housing member are dimensioned such that the inner member nests within the outer member as shown in the figure. The base and wall portions function as flux return paths of the magnetic structure. The respective base portions 55,58 are further formed with a substantially circular rise in the center forming respective pole pieces 61,60 of the magnetic structure.

Spool 67 formed from nylon or other suitable material contains coil 68 comprising multiple turns of a suitable insulated conductor. In the present example, coil 68 is a single winding, that is to say a continuous, monofilament, unidirectional coil. The two ends of the coil are terminated such as by wrapping and soldering to coil leads 52. The coil and spool are handled as a single unit and are assembled to the inner housing member 57 prior to mating the outer housing member thereto.

Armature assembly 63 includes a non-magnetic shaft 69 which may be formed of a non-magnetic metal or any suitable engineering plastic. The shaft is assembled at one end to a permanent magnet 66, in this embodiment an annular magnet having a central aperture receives one end of the shaft. Permanent magnet material may be any suitable magnet material including, preferably, a high strength formulation such as samarium cobalt or neodymium. The upper face of the magnet 66 abuts a spacing flange 65 which provides a positive stop for armature assembly travel in the upward direction in the figure. A travel stop which maintains the permanent magnet in spaced adjacency with the pole piece 61 is generally desirable owing to the characteristically fragile nature of the permanent magnet material and the desirability of preventing slamming of the magnet directly against the pole piece. The permanent magnet 66 may be assembled to the shaft 69 prior to or subsequent to shaft placement through aperture 62 formed centrally through the circular rise in base portion 55 of outer housing member 51. Magnet 66 is magnetized such that the poles thereof are aligned substantially with the stroke axis of the armature assembly. Each face of the magnet therefor may be referred to as a respective pole face.

Alternative structures for the armature portion just described include armature assemblies formed in a plastic insert molding process wherein a magnetic ring is insert molded to a plastic shaft. Also, a multi-stage powder metal compression process may be utilized to form the permanent magnet from one suitable material and the shaft from another suitable material. It is also suggested that a multi-stage plastic coated powder metal process be employed to similarly produce a structurally unitized armature assembly. Combinations of these techniques may also be obvious expedients within the capabilities of one skilled in the art.

In the present embodiment, after assembly of the magnet and shaft through the aperture in the outer housing member, the outer and inner housing members are assembled together as illustrated in the figure. This captures the spool and coil within the housing. An offset aperture in the base portion of the outer housing member provides for externalization of the coil leads 52. The aperture may later be filled with a suitable potting material such as epoxy or silicone to seal the aperture. A central clearance is provided between the respective base portions of the housing members within which the armature assembly may move without restriction from one travel stop to the other.

The embodiment illustrated in FIG. 2 being a relay adapted for mounting to one side of a circuit board substrate 70 and operating to short electrical contact pads 75 on the opposite side of the circuit board first requires assembly to the circuit board substrate prior to completion of the armature assembly 63. The relay is secured to the underside of the circuit board substrate 70 such that the shaft 69 protrudes through a clearance in the circuit board. Additionally, coil leads 52 protrude through the circuit board substrate for coupling to controlled lines for energizing the coil 68. Disposed at the periphery of the clearance on the top side of the circuit board are electrical contact pads 75 which are joined to respective conductors 71. Contact bridge 76, formed from a substantially rigid conductive material such as beryllium-copper alloy, is affixed to the exposed end of shaft 69. A shoulder 72 formed at the exposed end of the shaft 69 provides a seat for the contact bridge 76 which is secured thereto by spreading preformed cleft 74 at the extreme end of the shaft. Alternatively, other means of fastening may be employed such as a threaded shaft and nut or heat staking by deformation of the exposed portion of the shaft through the contact bridge. At either end of contact bridge are contact pads 73 which are electrically and physically coupled thereto. In the figure, one preferred way of providing such contact pads is by way of riveted attachment where the contact pad is a solid rivet. One preferred material for contact pads 75 and 73 is silver or a silver alloy. The contact pads 73 and 75 are substantially aligned such that electrical continuity can be established from one contact pad 75 to the other contact pad 75 through the contact bridge 76 and corresponding contact pads 73 carried thereby.

With all relevant parts and assemblies of FIG. 2 having been described, certain benefits and operation of the relay may now be explored. A substantial portion of the magnetic circuit of the apparatus includes the housing assembly. Being formed of magnetic material, the housing provides for high permeance flux paths. Being formed to surround and encase the coil, the housing substantially limits low permeance portions of the magnetic circuit to the clearance between the pole pieces including the permanent magnet. A variable air gap is provided between each respective pole piece 61 and 60 and corresponding facing pole of the permanent magnet. It was earlier noted that flange 65 provides a positive stop for armature assembly travel in the upward direction in the figure. Positive travel stop in the opposite direction downward in the figure is provided by the contact pads 75 and 73 abutting thereby leaving a finite air gap between the pole piece 60 and corresponding facing pole of the permanent magnet. In each respective travel stop position, the permanent magnet 66 provides a magnetic attractive force between one pole face and the adjacent pole piece 60 or 61 sufficient to latch the armature assembly 63 in the respective position. The air gap associated with the latched position may be referred to as the dominant air gap. Generally, for symmetrical structures the magnetic attractive force is going to be greater across the smaller of the two air gaps between the pole faces of the permanent magnet and the pole pieces; however, pole piece and magnet geometry may significantly effect the attractive force characteristics and may render this generality less than accurate. Hence, it is most correctly stated that the dominant air gap is the one of the air gaps across which the magnetic attractive force exceeds that across the other of the air gaps. Each of the air gaps is variable in accordance with the stroke of the armature assembly and hence the permanent magnet position between the pole pieces.

Particularly with respect to the dominant air gap associated with the latched position corresponding to the closure of the contacts, apart from the advantage of preventing direct contacting of the permanent magnet and pole piece and previously discussed benefit of damage prevention, the non-contacting air gap also provides the benefit of consistently low impedance across the contact pairs 75 and 73. It is well known that the contacts of relays are prone to physical and electrical wear over cycles. It is also well known that increasing contact force will generally reduce contact resistance. Minimum contact resistance is of particular benefit in small signal applications such as with voltage levels generally associated with circuit board applications, and may also be significantly beneficial in large signal applications where high impedance results in large ohmic losses and increased contact heating. As the contact pairs wear, the non-contacting air gap is reduced. As the magnet to pole piece separation is decreased, the attractive force therebetween is increased which results in a proportional increase in the contact force.

Being bistable, the relay will assume one of two positions in accordance with the dominant air gap. In order that the latch state of the relay be altered, it is necessary to overcome the magnetic attractive force of the dominant air gap and cause the armature assembly to move into the other latched position. Coil 68 is wound and coupled to a voltage source in such a manner as to produce magnetic flux in the magnetic circuit which results in a magnetic repulsive force across the dominant air gap. This is accomplished in the single coil winding of the present embodiment by unidirectional energization of the coil in the direction that produces like polarities at each pole piece and facing permanent magnet pole. For example, if the polarity of the permanent magnet is such that the north to south pole orientation of the magnet is from top to bottom in the figure or alternatively stated from the face of the permanent magnet adjacent the pole piece 61 to the face of the permanent magnet adjacent the pole piece 60, the coil winding direction and energization direction are chosen to produce north and south poles at pole piece 61 and 60 respectively. While it is observed that magnetic repulsive forces are established between the magnet and each pole piece 60 and 61, the dominant air gap will always experience the greater force and hence the net effect is to repel the magnet (and armature assembly) away from the associated pole piece. The energization of the coil is therefore temporal in character; that is to say is pulsed or time limited such that the magnetic repulsive force across the dominant air gap repels the armature assembly setting it in motion whereafter the armature assembly's momentum after deenergization carries it into the other latched position with the other air gap now being dominant. The same process, including the same energization direction of the coil, is repeated to toggle the latched state from the lower position to the upper position. the timing requirements of the pulsed energization is a function, among other considerations, of armature mass, stroke, coil impedances, and energization voltage.

Figure 3:
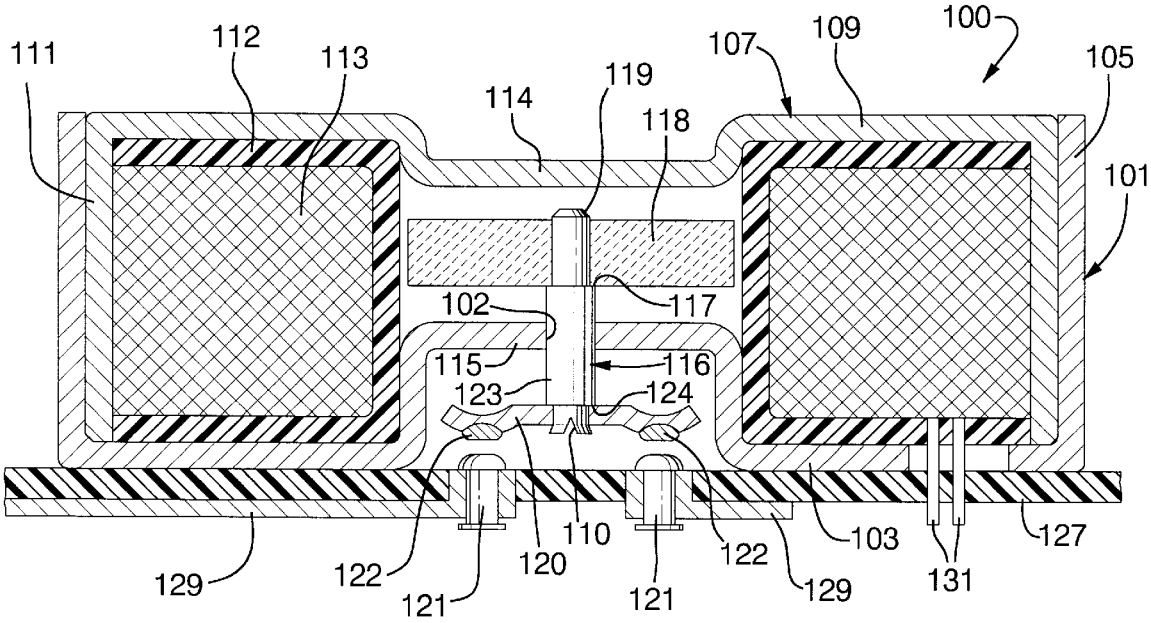

With reference now to FIG. 3, a second single coil embodiment of a bistable magnetically latching relay embodying the solenoid apparatus of the present invention is illustrated. Operatively, the magnetic circuit is equivalent to that of the embodiment described with respect to the relay of FIG. 2. In application, the relay 100 of FIG. 3 couples contact pairs 122 and 121 on the same side of the circuit board substrate 127 as the relay 100 is assembled. In the present example, alternative contact coupling to the circuit board includes riveted contacts 121 which pass through the substrate forming contact pads on the top surface. The contacts 121 electrically couple to conductors 129 on the underside of the substrate.

The relay housing as in the previously described embodiment includes outer housing member 101 and inner housing member 107, each formed from suitable magnetic material and preferably stamped from 20 mil 1008 steel. Each housing member includes a respective base portion 103, 109 and wall portion 105, 111. The base portions are preferably substantially round and the wall portions are substantially annular extending normal to the base portions at the outer periphery thereof. The inner housing member and outer housing member are dimensioned such that the inner member wall nests within the outer member as shown in the figure. The respective base portions 105, 109 are further formed with a substantially circular rise in the center forming respective pole pieces 114, 115 of the magnetic structure.

Spool 112 formed from nylon or other suitable material contains single-winding coil 113 comprising multiple turns of a suitable insulated conductor. The two ends of the coil are terminated such as by wrapping and soldering to coil leads 131. The coil and spool are handled as a single unit and are assembled to the inner housing member 107 prior to mating the outer housing member thereto.

Armature assembly 116 includes a non-magnetic shaft 123 which may be formed of a non-magnetic metal or any suitable engineering plastic. The shaft is assembled at one end to a permanent magnet 118 through a central aperture receiving one end of the shaft. Depth of insertion of the shaft through the aperture is controlled by shoulder 117. Permanent magnet material may be any suitable magnet material including, preferably, a high strength formulation such as samarium cobalt or neodymium. The shaft 123 extends slightly through the central aperture to provide a positive stop for armature assembly travel in the upward direction in the figure. A travel stop which maintains the permanent magnet in spaced adjacency with the pole piece 114 is generally desirable owing to the characteristically fragile nature of the permanent magnet material and the desirability of preventing slamming of the magnet directly against the pole piece. The permanent magnet 118 may be assembled to the shaft 123 prior to or subsequent to shaft placement through aperture 102 formed centrally through the circular rise in base portion 103 of outer housing member 101. Magnet 118 is magnetized such that the poles thereof are aligned substantially with the stroke axis of the armature assembly and each face of the magnet therefore may be referred to as a respective pole face.

Alternative structures for the armature portion just described include armature assemblies formed in a plastic insert molding process wherein a magnetic ring is insert molded to a plastic shaft. Also, a multi-stage powder metal compression process may be utilized to form the permanent magnet from one suitable material and the shaft from another suitable material. It is also suggested that a multi-stage plastic coated powder metal process be employed to similarly produce a structurally unitized armature assembly. Combinations of these techniques may also be obvious expedients within the capabilities of one skilled in the art.

In the present embodiment, subsequent to assembly of the magnet to the shaft and the shaft through the aperture in the outer housing member, the outer and inner housing members may be assembled together as illustrated in the figure. This assembly sequence may be altered in this embodiment pending assembly of the bridge contact 120 to the shaft 123 as described below. Assuming the housing is first closed by mating the inner and outer housings, the spool and coil are closed within the housing. An offset aperture in the base portion of the outer housing member provides for externalization of the coil leads 131 which may later be filled with a suitable potting material such as epoxy or silicone to seal the aperture. A central clearance is provided between the respective base portions of the housing members within which the armature assembly may move without restriction from one travel stop to the other.

Contact bridge 120, formed from a substantially rigid conductive material such as beryllium-copper alloy, is affixed to the exposed end of shaft 123. A shoulder 117 formed at the exposed end of the shaft 123 provides a seat for the contact bridge 120 which is secured thereto by spreading preformed cleft 110 at the extreme end of the shaft. Alternatively, other means of fastening may be employed such as a threaded shaft and nut or heat staking by deformation of the exposed portion of the shaft through the contact bridge. At either end of contact bridge are contact pads 122 which are electrically and physically coupled thereto. In the figure, one preferred way of providing such contact pads is by way of contact pad inlay into the contact bridge in accord with well known techniques. One preferred material for contact pads 122, 121 is silver or a silver alloy. The contact pads 122, 121 are substantially aligned such that electrical continuity can be established from one contact pad 121 to the other contact pad 121 through the contact bridge 120 and corresponding contact pads 122 carried thereby. Additionally, coil leads 131 protrude through the circuit board substrate for coupling to controlled lines for energizing the coil 113.

Operative description of the relay depicted in FIG. 3 is not given here as the operation is substantially analogous to the description given in relation to the embodiment of FIG. 2.

Figure 1:
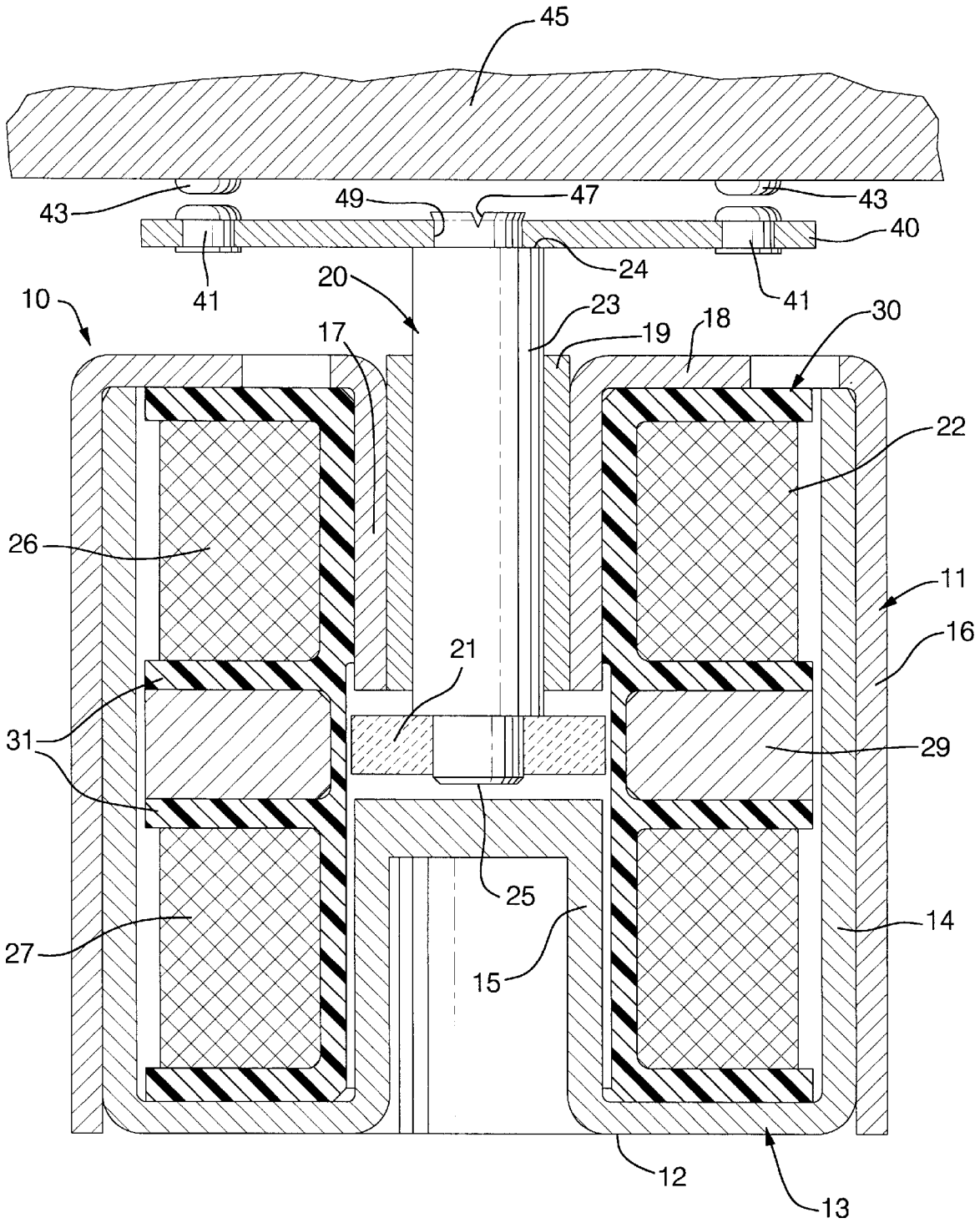
FIG. 1 illustrates a first embodiment of the present invention in sectional view of a dual-winding bistable magnetically latched relay in accord with the present invention.

With reference now to FIG. 1, a preferred embodiment of a dual-winding coil solenoid controlled apparatus in accord with the present invention is illustrated. The invention is once again embodied in a relay 10 having the same benefits as the earlier described relays. From a functional standpoint, the relay 10 of the present example is adapted to close the circuit between contact pads 43 by way of contact pads 41 and contact bridge 40. The dominant air gap between permanent magnet 21 and pole pieces 17 and 15 establishes the armature assembly 20 into one of two bistable, magnetically latched positions. The relay housing is similar in structure to the previously described relays having inner and outer housing members 13 and 11 respectively. The housing members may be formed by conventional deep draw stamping process to yield the relatively high aspect ratio of the wall portions 14, 16 to respective base portions 12 and 18. Again, a suitable material is conventional stamping stock 1008 steel. The aperture through the base portion 18 is cylindrical also having a relatively high aspect ratio of length along the stroke axis of the apparatus to diameter. A non-magnetic slide bushing 19 provides a preferred material interface with the shaft and improved surface tolerancing than otherwise available directly on the stamped wall surface of pole piece 17 which surrounds the armature shaft 23.

A central clearance is provided between the respective pole pieces of the housing members within which the armature assembly may move without restriction from one travel stop to the other.

In the present embodiment, spool 30 is formed from nylon or other suitable material. A pair of ribs 31 define upper, lower and intermediate areas of the spool which contain first and second windings 26, 27 and flux return member 29, respectively. Flux return member 29 is preferably formed of a suitable high permeability material and may be an annulus split along a diameter in two pieces to aid assembly to a preformed spool. Alternatively, a unitary flux return member 29 may be insert molded during fabrication of the spool. Dual-winding coil 22 comprises multiple turns of a suitable insulated conductor. The dual-winding coil 22 arrangement and manner of energization (bidirectional or unidirectional, and concurrent or mutually exclusive) may be varied. Examples of such variety will be described at a later point herein.

Armature assembly 20 includes a non-magnetic shaft 23 which may be formed of a non-magnetic metal or any suitable engineering plastic. The shaft is assembled at one end to a permanent magnet 21, in this embodiment an annular magnet having a central aperture receives one end of the shaft. The shaft is assembled at one end to a permanent magnet 21 through a central aperture receiving one end of the shaft. Depth of insertion of the shaft through the aperture is controlled by a shoulder on the shaft. Permanent magnet material may be any suitable magnet material including, preferably, a high strength formulation such as samarium cobalt or neodymium. The shaft 23 extends slightly through the central aperture to provide a positive stop for armature assembly travel in the downward direction in the figure. A travel stop which maintains the permanent magnet in spaced adjacency with the pole piece 15 is generally desirable owing to the characteristically fragile nature of the permanent magnet material and the desirability of preventing slamming of the magnet directly against the pole piece. The permanent magnet 21 may be assembled to the shaft 23 prior to or subsequent to shaft placement through slide bushing 19. Magnet 21 is magnetized such that the poles thereof are aligned substantially with the stroke axis of the armature assembly and each face of the magnet therefore may be referred to as a respective pole face.

Alternative structures for the armature portion just described include armature assemblies formed in a plastic insert molding process wherein a magnetic ring is insert molded to a plastic shaft. Also, a multi-stage powder metal compression process may be utilized to form the permanent magnet from one suitable material and the shaft from another suitable material. It is also suggested that a multi-stage plastic coated powder metal process be employed to similarly produce a structurally unitized armature assembly. Combinations of these techniques may also be obvious expedients within the capabilities of one skilled in the art.

In the present embodiment, after assembly of the magnet to the shaft and the shaft through the slide bushing, the outer and inner housing members are assembled together as illustrated in the figure. This assembly sequence may be altered in this embodiment pending assembly of the bridge contact 40 to the shaft 23 as described below. Assuming the housing is first closed by mating the inner and outer housings, the spool, coil and flux return member are closed within the housing. An offset aperture in the base portion of the outer housing member provides for externalization of the coil leads (not shown). The aperture may later be filled with a suitable potting material such as epoxy or silicone to seal the aperture. A central clearance is provided between the respective base portions of the housing members within which the armature assembly may move without restriction from one travel stop to the other.

Contact bridge 40, formed from a substantially rigid conductive material such as beryllium-copper alloy, is affixed to the exposed end of shaft 23. A shoulder 24 formed at the exposed end of the shaft 23 provides a seat for the contact bridge 40 which is secured thereto by spreading preformed cleft 47 at the extreme end of the shaft. Alternatively, other means of fastening may be employed such as a threaded shaft and nut or heat staking by deformation of the exposed portion of the shaft through the contact bridge. At either end of contact bridge are contact pads 41 which are electrically and physically coupled thereto. As illustrated in the figure, one preferred way of providing such contact pads is by riveted attachment where the contact pad is a solid rivet. One preferred material for contact pads 41, 43 is silver or a silver alloy. The contact pads 41, 43 are substantially aligned such that electrical continuity can be established from one contact pad 43 to the other contact pad 43 through the contact bridge 40 and corresponding contact pads 41 carried thereby. Contact pads 43 are carried by an appropriate substrate 45 which may be a circuit board or base of an integral relay having terminal blades (not shown) adapted for plug-in application as conventionally practiced. Of course, suitable provisions can be made to prevent contact bridge rotation and assure contact pad alignment.

With all relevant parts and assemblies of FIG. 1 having been described, save the dual-winding coil 22 which will be described below, certain benefits and operation of the relay may now be explored. Generally the latch states, wherein one of the two described variable air gaps between the faces of the permanent magnet and corresponding pole piece is dominant, are equivalent to those described with respect to the earlier embodiments. As was earlier noted, positive travel stop in the closed contact direction provided by the contact pads 41 and 43 abutting advantageously provides the benefit of consistently low impedance across the contact pairs throughout the life of the relay.

Being bistable, the relay 10 will assume one of two positions in accordance with the dominant air gap. In order that the latch state of the relay be altered, it is necessary to overcome the magnetic attractive force of the dominant air gap and cause the armature assembly to move into the other latched position. Dual-winding coil 22 is wound and energized in such a manner as to produce magnetic flux in the magnetic circuit which results in a magnetic repulsive force across the dominant air gap. Additionally, dual-winding coil 22 may be wound and energized in such a manner as to produce magnetic flux in the magnetic circuit which simultaneously results in a magnetic attractive force across the opposite air gap. Therefore, in one arrangement, each winding 26 and 27 is independently and unidirectionally energizable to establish magnetic repulsive force across the respective air gap. In such an arrangement, each winding is only energized when the dominant air gap is associated with the pole piece surrounded by the winding being energized to change the latch state. In another arrangement wherein each winding is energizable bidirectionally, each winding is energized at each state change in a direction which will generate magnetic repulsive force at the dominant air gap and magnetic attractive force at the other air gap. The windings in such an arrangement may be coupled in parallel fashion and share a common pair of input terminal whose energization polarity is toggled in accord with the desired latch state of the apparatus. In yet another arrangement, the windings are coupled in series such that energization across the pair produces the same polarity at each hole piece which will effectively provide a magnetic repulsive force across one of the air gaps and magnetic attractive force across the other air gap. Such arrangement also requires bidirectional energization to enable the apparatus to toggle latch states. In each of the various dual winding arrangements described, the timing of the energization is not as critical since the flux return member carries a majority of the magnetic circuit flux thus minimizing any magnetic repulsive force across the air gap opposite the dominant air gap. In fact, a magnetic attractive force is established across the air gap opposite the dominant air gap in the two described arrangements wherein the windings are coincidentally energized.

While the present invention has been described by way of certain preferred embodiments, it is to be understood that various modifications to the invention may be apparent to those having ordinary skill in the art. Hence, the embodiments described herein are to be taken by way of non-limiting example of the invention which is to be limited only in accordance with the claims as appended hereto.

We claim:

1. A bistable magnetically latched solenoid apparatus comprising:

an armature assembly attached to a permanent magnet, said armature assembly adapted for travel along a stroke axis, said permanent magnet being characterized by magnetic poles oriented substantially parallel to the stroke axis of the armature assembly;

a magnetic circuit including first and second pole pieces and the permanent magnet, said permanent magnet being intermediate the pole pieces to define a first variable air gap between the first pole piece and corresponding facing permanent magnet pole and a second variable air gap between the second pole piece and corresponding facing permanent magnet pole, each variable air gap having a respective magnetic attractive force established thereacross by the permanent magnet;

said apparatus characterized by a dominant air gap comprising the one of the first and second variable air gaps across which the respective magnetic attractive force exceeds the respective magnetic attractive force across the other of the first and second variable air gaps wherein the magnetic attractive force across the dominant air gap establishes the apparatus into a prevailing one of first and second magnetically latched conditions;

a coil for producing flux in the magnetic circuit when temporally energized to establish magnetic repulsive force across the dominant air gap to force the apparatus out of the prevailing one of the first and second magnetically latched conditions and into the other of the first and second magnetically latched conditions; and, a first electrical contact in communication with said armature assembly in a manner to translate armature travel to said first electrical contact for coupling and decoupling the first electrical contact and a second electrical contact, said first and second electrical contacts being coupled in one of the first and second latched conditions and decoupled in the other of the first and second latched conditions, said first and second electrical contacts cooperatively providing a travel stop for said armature in the one of the first and second latched conditions providing coupling of the electrical contacts thereby preventing contact of the respective pole piece and corresponding facing permanent magnet pole, whereby force at the electrical contact interface corresponds directly to the respective magnetic attractive force at the one of the first and second air gaps characterized by the dominant magnetic attractive force when the electrical contacts are coupled.

2. A electrical switch apparatus as claimed in claim 1 wherein said coil surrounds the stroke axis.

3. A electrical switch apparatus as claimed in claim 1 wherein said coil surrounds the stroke axis.

4. A electrical switch apparatus as claimed in claim 1 wherein said coil is a dual-winding coil.

5. A bistable magnetically latched solenoid apparatus comprising:

an armature assembly attached to a permanent magnet, said armature assembly adapted for travel along a stroke axis, said permanent magnet being characterized by magnetic poles oriented substantially parallel to the stroke axis of the armature assembly;

a magnetic circuit including first and second pole pieces, the permanent magnet, and a flux return member, said permanent magnet being intermediate the pole pieces to define a first variable air gap between the first pole piece and corresponding facing permanent magnet pole and a second variable air gap between the second pole piece and corresponding facing permanent magnet pole, each variable air gap having a respective magnetic attractive force established thereacross by the permanent magnet, said flux return member in spaced adjacency to the permanent magnet in a direction substantially orthogonal to said stroke axis;

said apparatus characterized by a dominant air gap comprising the one of the first and second variable air gaps across which the respective magnetic attractive force exceeds the respective magnetic attractive force across the other of the first and second variable air gaps wherein the magnetic attractive force across the dominant air gap establishes the apparatus into a prevailing one of first and second magnetically latched conditions;

first and second windings, each winding independently temporally energizable to produce flux in the magnetic circuit to establish magnetic repulsive force across a respective one of the air gaps to thereby force the apparatus out of the prevailing one of the first and second magnetically latched conditions and into the other of the first and second magnetically latched conditions when the respective one of the air gaps is the dominant air gap; and, a first electrical contact in communication with said armature assembly in a manner to translate armature travel to said first electrical contact for coupling and decoupling the first electrical contact and a second electrical contact, said first and second electrical contacts being coupled in one of the first and second latched conditions and decoupled in the other of the first and second latched conditions, said first and second electrical contacts cooperatively providing a travel stop for said armature in the one of the first and second latched conditions providing coupling of the electrical contacts thereby preventing contact of the respective pole piece and corresponding facing permanent magnet pole, whereby force at the electrical contact interface corresponds directly to the respective magnetic attractive force at the one of the first and second air gaps characterized by the dominant magnetic attractive force when the electrical contacts are coupled.

6. A bistable magnetically latched solenoid apparatus as claimed in claim 5 wherein each winding is energizable in concert with the other to produce flux in the magnetic circuit to establish magnetic repulsive force across the dominant air gap and magnetic attractive force across the other air gap to thereby force the apparatus out of the prevailing one of the first and second magnetically latched conditions and into the other of the first and second magnetically latched conditions.

7. A bistable magnetically latched solenoid apparatus as claimed in claim 6 wherein said windings are coupled in parallel.

8. A bistable magnetically latched solenoid apparatus as claimed in claim 6 wherein said windings are coupled in series.

* * * * *